US005386958A

United States Patent [19]

Amato

[11] Patent Number: 5,386,958

[45] Date of Patent: Feb. 7, 1995

[54] FEEDING TUBE SUPPORT APPARATUS

[76] Inventor: Albert R. Amato, 299 Hawthorne Ave., Uniondale, N.Y. 11553

[21] Appl. No.: 78,924

[22] Filed: Jun. 21, 1993

[51] Int. Cl.[6] ..... A47G 23/00

[52] U.S. Cl. ..... 248/146; 248/150; 248/311.2

[58] Field of Search ..... 248/146, 150, 121, 122, 248/311.2, 311.3

[56] References Cited

U.S. PATENT DOCUMENTS

| | | | |
|---|---|---|---|
| 2,522,345 | 9/1950 | Cashiopp | 248/121 |
| 3,026,079 | 3/1962 | Stack | 248/311.3 X |
| 3,298,648 | 1/1967 | Sepanski | 248/311.3 X |
| 3,971,538 | 7/1976 | Marvich | 248/122 X |
| 4,262,872 | 4/1981 | Kodet | 248/311.3 |
| 4,278,225 | 7/1981 | Phelps | 248/311.3 |

*Primary Examiner*—Alvin C. Chin-Shue
*Assistant Examiner*—Derek J. Berger
*Attorney, Agent, or Firm*—E. Michael Combs

[57] ABSTRACT

A feeding tube support includes a base plate having a pedestal, with the pedestal having a support leg pivotally mounted to the pedestal, the pedestal and support leg further including a further support leg pivotally mounted to an uppermost end of the support leg, with the further support leg including an opening directed therethrough for the mounting of a feed tube, and the feed tube in fluid communication with a gastronomy tube. The structure is arranged for interfolding for compact storage and transport during periods of non-use.

3 Claims, 5 Drawing Sheets

FIG. 1
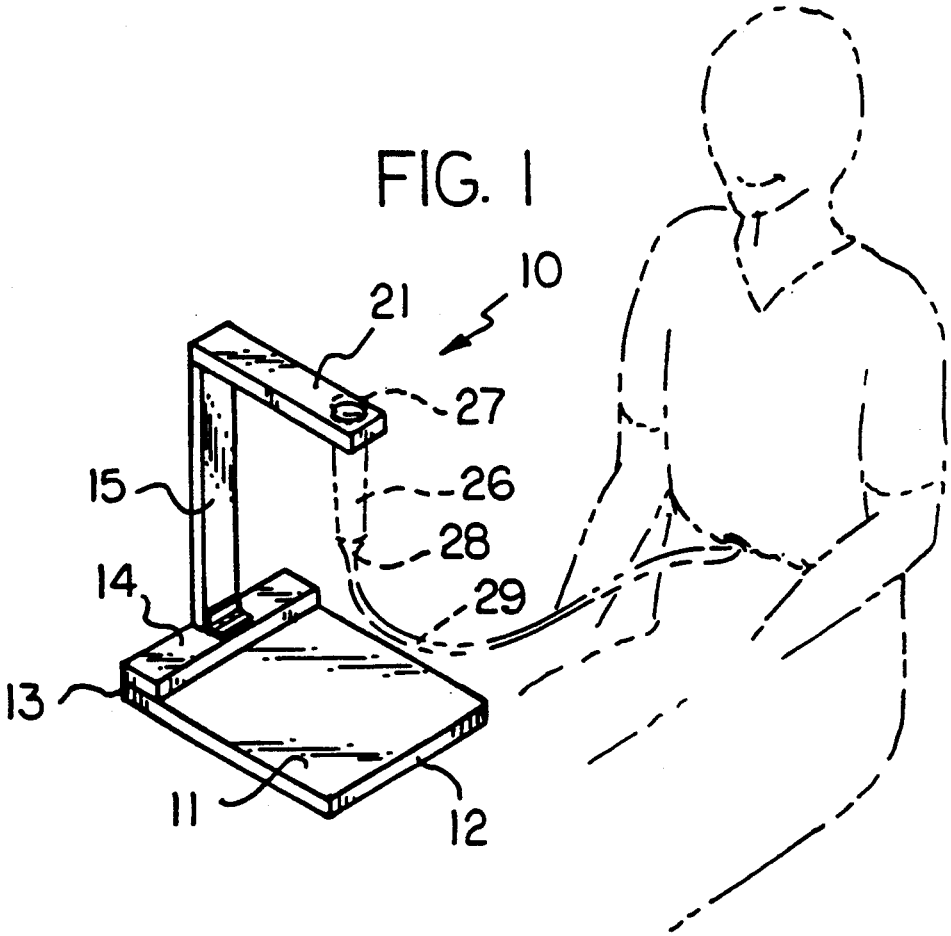
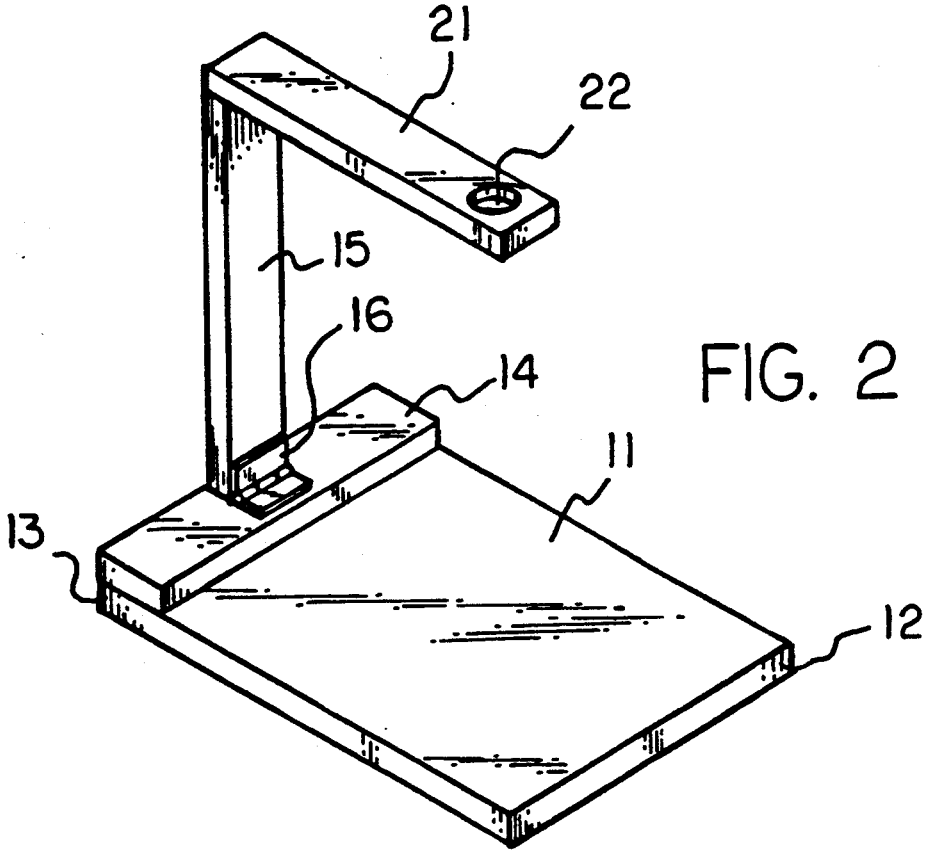
FIG. 2

FEEDING TUBE SUPPORT APPARATUS

BACKGROUND OF THE INVENTION

1. Field of the Invention

The field of invention relates to gastronomy feeding apparatus, and more particularly pertains to a new and improved feeding tube support apparatus arranged for the positioning and mounting of a feeding tube in cooperation with a gastronomy tube.

2. Description of the Prior Art

Feeding tube structure of various types have been utilized throughout the prior art and in conditions of use of a gastronomy tube, a patient is fed through an opening for the feeding of the digestive tract through a surgical opening.

The instant invention attempts to overcome deficiencies of the prior art by availing itself of the use of a readily mounted and erected feeding tube support structure arranged for securement into an opened configuration and permitting interfolding of the components for ease of storage and transport and in this respect, the present invention substantially fulfills this need.

SUMMARY OF THE INVENTION

In view of the foregoing disadvantages inherent in the known types of feed tube structure now present in the prior art, the present invention provides a feeding tube support apparatus wherein the same includes a plurality of interfolding links arranged for interlocking engagement relative to one other for supporting of a feed tube. As such, the general purpose of the present invention, which will be described subsequently in greater detail, is to provide a new and improved feeding tube support apparatus which has all the advantages of the prior art feed tube structure and none of the disadvantages.

To attain this, the present invention provides a feeding tube support including a base plate having a pedestal, with the pedestal having a support leg pivotally mounted to the pedestal, the pedestal and support leg further including a further support leg pivotally mounted to an uppermost end of the support leg, with the further support leg including an opening directed therethrough for the mounting of a feed tube, and the feed tube in fluid communication with a gastronomy tube. The structure is arranged for interfolding for compact storage and transport during periods of non-use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved feeding tube support apparatus which has all the advantages of the prior art feeding tube support apparatus and none of the disadvantages.

It is another object of the present invention to provide a new and improved feeding tube support apparatus which may be easily and efficiently manufactured and marketed.

It is a further object of the present invention to provide a new and improved feeding tube support apparatus which is of a durable and reliable construction.

An even further object of the present invention is to provide a new and improved feeding tube support apparatus which is susceptible of a low cost of manufacture with regard to both materials and labor, and which accordingly is then susceptible of low prices of sale to the consuming public, thereby making such feeding tube support apparatus economically available to the buying public.

Still yet another object of the present invention is to provide a new and improved feeding tube support apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the invention in use.

FIG. 2 is an enlarged isometric illustration of the invention.

DESCRIPTION OF THE PREFERRED EMBODIMENT

Figure 3:
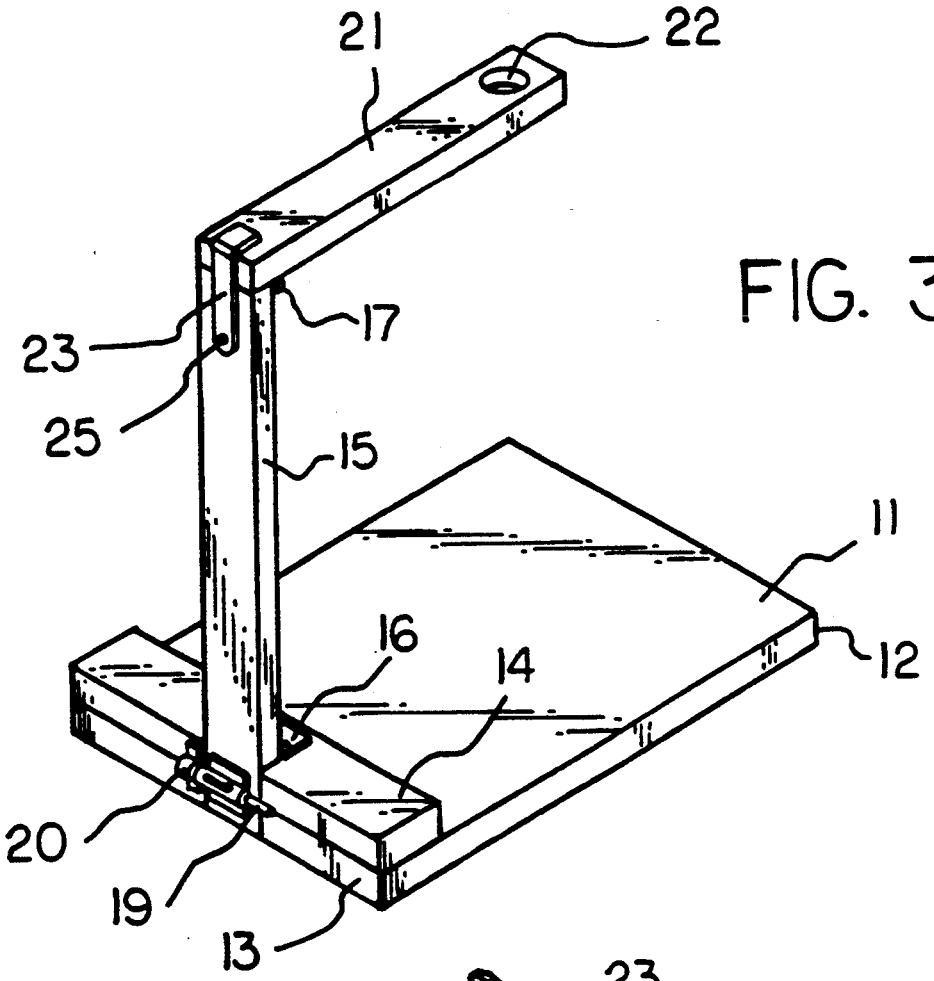
FIG. 3 is an isometric rear view of the invention in a locked opened configuration.
Figure 4:
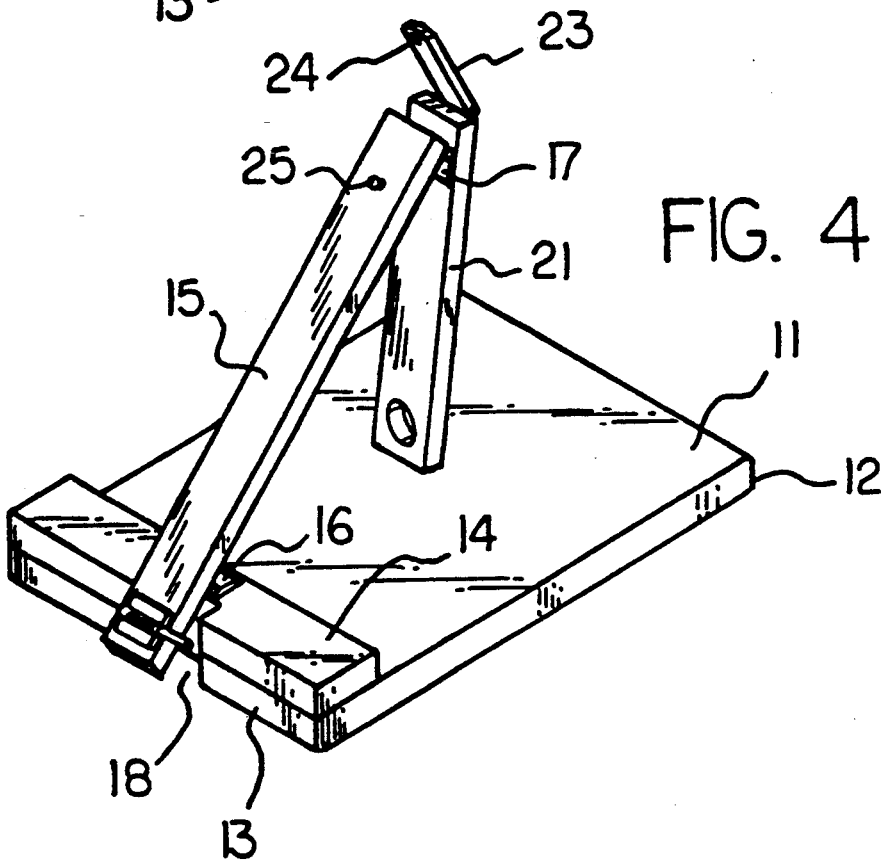
FIG. 4 is an isometric rear view of the invention arranged for interfolding relative to a storage position.

With reference now to the drawings, and in particular to FIGS. 1 to 8 thereof, a new and improved feeding tube support apparatus embodying the principles and concepts of the present invention and generally designated by the reference numeral 10 will be described.

More specifically, the feeding tube support apparatus 10 of the instant invention essentially comprises a base plate 11, having a first end 12 spaced from a second end 13, with a pedestal 14 having a predetermined height mounted to the base plate adjacent the second end 13. A support leg 15 having a support leg first end hingedly mounted to the pedestal 14 about a first hinge 16 includes a second hinge 17 mounted to the support plate leg second end. A recess 18 having a predetermined depth equal to the predetermined thickness of the support leg is positioned in adjacency to the first hinge 16 to receive the support leg 15 and the support leg first end portion therewithin in a flush manner such that a latch bolt 19 mounted to the support leg 15 adjacent the support leg first end is slidably mounted for reception within a latch bolt tube 20 secured to the base plate second end to latch the support leg 15 in an orthogonal orientation relative to the base plate 11, as indicated in FIG. 2 for example. A further support leg 21 having a leg thickness equal to the predetermined height of the pedestal is hingedly mounted at the further support leg first end to the second hinge 17, such as interfolding of the further support leg 21 along the first or further support leg 15 positions the further support leg between the support leg 15 and the base plate 11 in a compact manner. Further, a securement strap 23 having a securement strap opening 24 is provided, with the securement strap 23 mounted to the further support leg 21 at the further support leg first end spaced from the second hinge, with a lug 25 mounted to the support leg 15 arranged for projection through the securement strap opening 24 to latch the further support leg 21 in an orthogonal relationship relative to the support leg 15.

A fifth feed tube 26 is provided having a feed tube flange 27, with the feed tube 26 arranged for reception through and positioning through a further support leg opening 22 directed through the further support leg at the further support leg second end. The feed tube flange 27 prevents the feed tube from sliding completely through the further support leg opening 22 permitting the feed tube flange 27 to abut a top surface of the further support leg 21. A gastronomy tube 29 is directed from the feed tube 26 to the patient, in a manner as indicated in FIG. 1.

Figure 5:
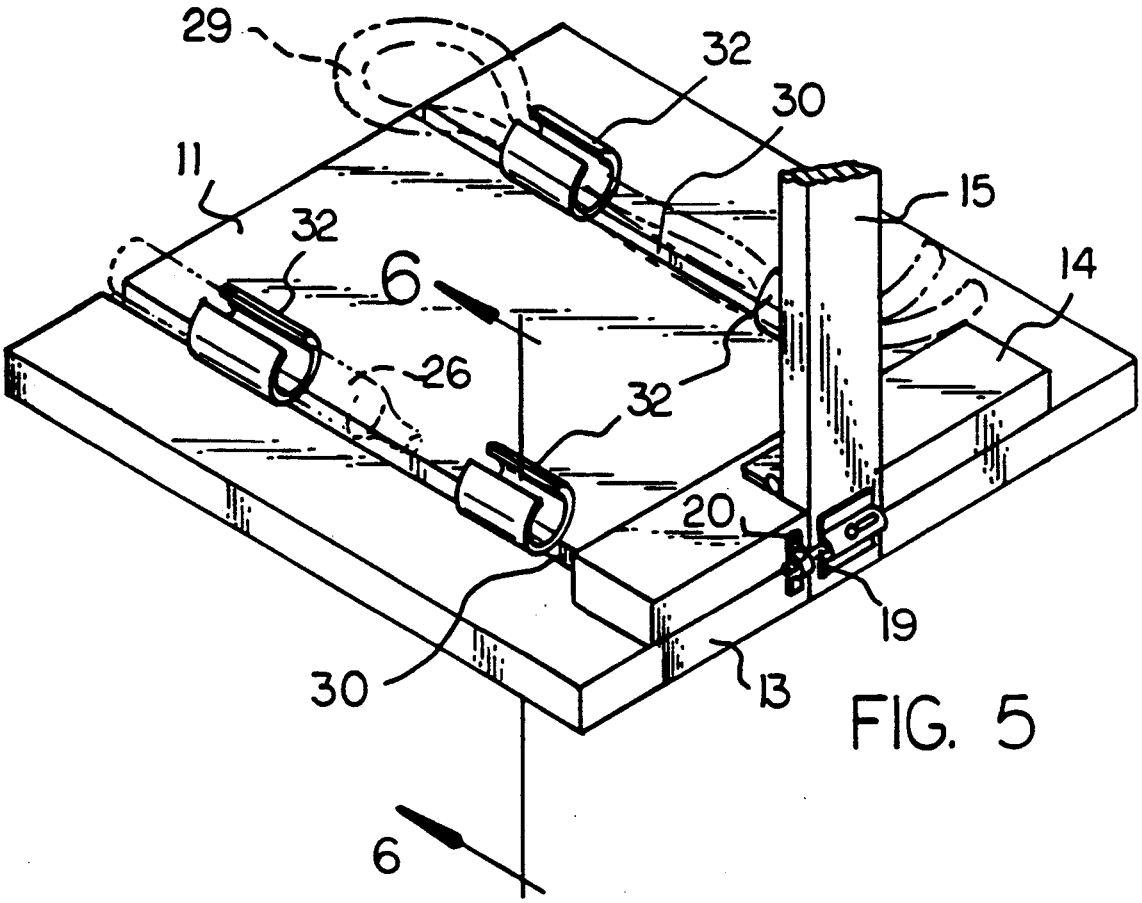
FIG. 5 is an isometric illustration of the invention including feed tube holder members mounted to the base plate of the invention.
Figure 6:
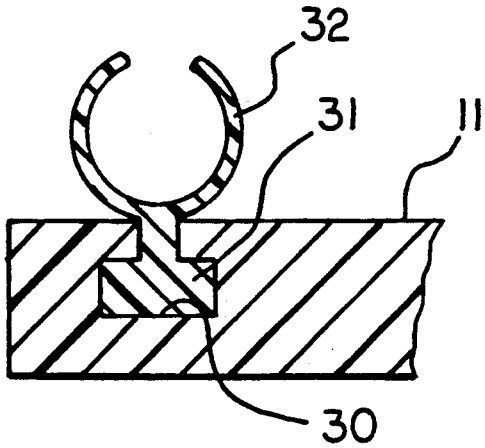
FIG. 6 is an orthographic view, taken along the lines 6—6 of FIG. 5 in the direction indicated by the arrows.

The FIG. 5 indicates the use of a plurality of T-shaped grooves 30 directed into the base plate, each slidably receiving at least one, and typically a plurality of, T-shaped lugs 31, with each of the T-shaped lugs 31 mounting a split cylindrical spring clamp 32, with each of the spring clamps 32 arranged for securement of further feed tubes 26 therewithin for storage and use, as the further support leg and support leg 21 and 15 respectively are positioned between the grooves 30 in an interfolded configuration.

Figure 7A:
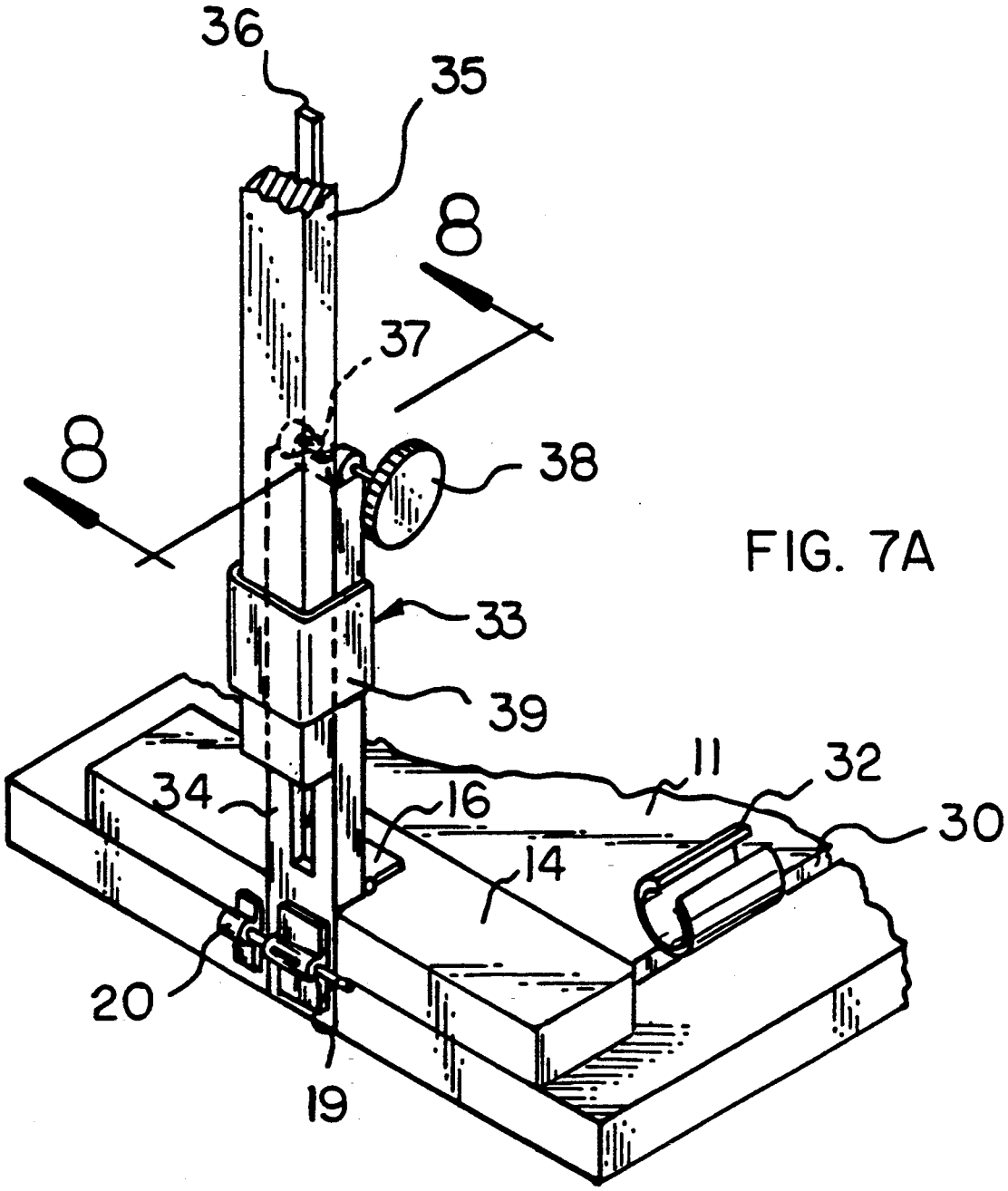
FIG. 7*a* is an isometric illustration of the invention with the modified support leg arranged in a reversed orientation to permit interfolding of the organization during non-use and storage.
Figure 7:
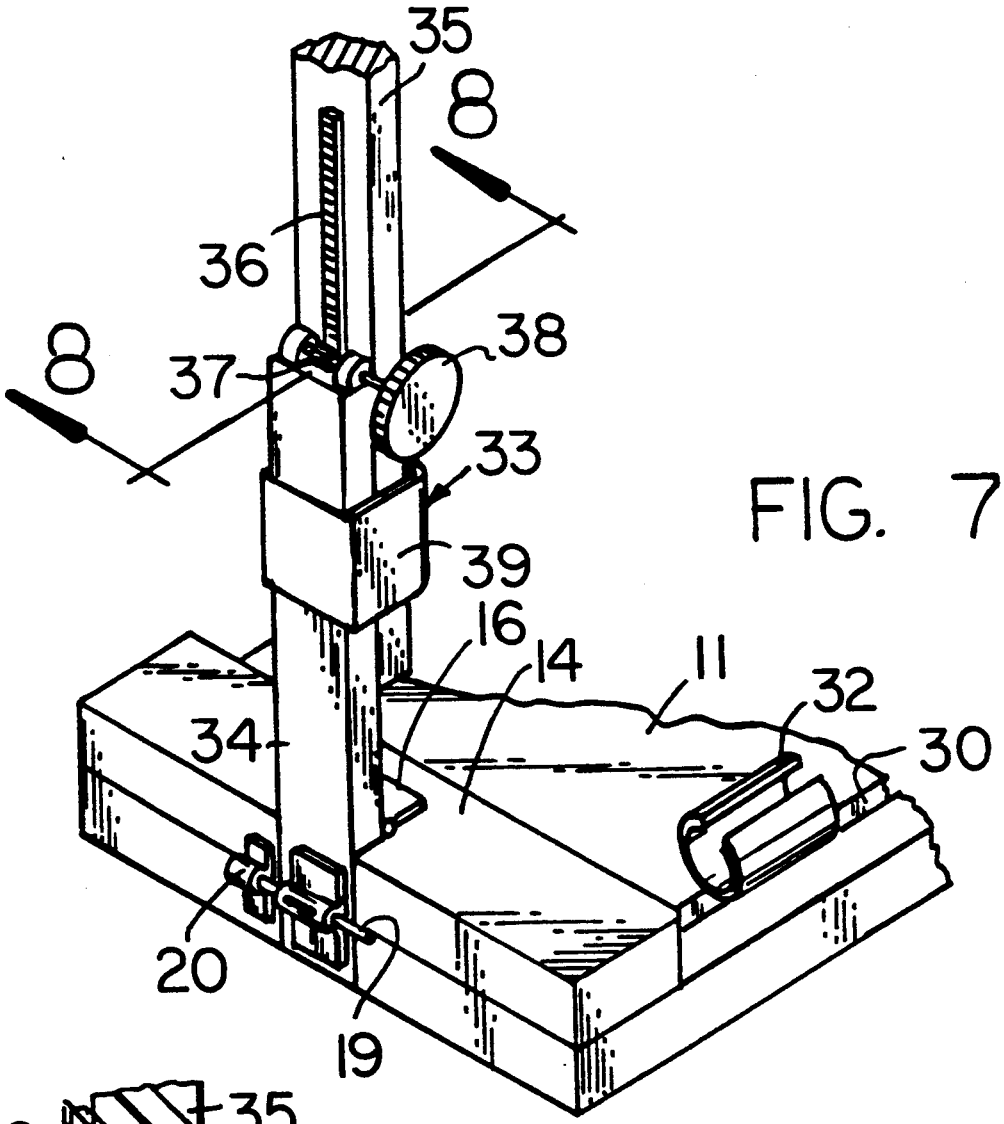
FIG. 7 is an isometric illustration of the invention employing a modified support leg structure to permit elevational repositioning of the further support leg and the associated feed tube.
Figure 8:
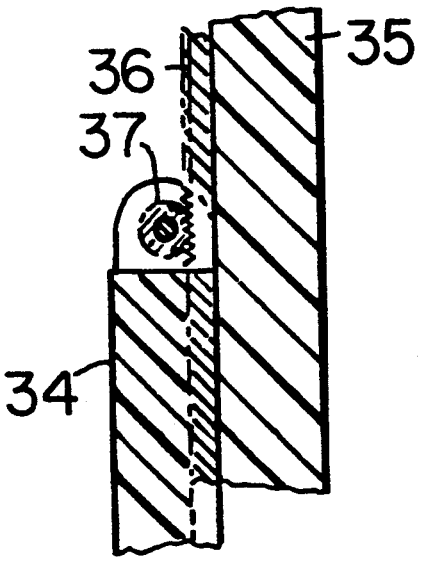
FIG. 8 is an orthographic view, taken along the lines 8—8 of FIG. 7 in the direction indicated by the arrows.

The FIGS. 7 and 8 indicate the use of a modified support leg structure 33, having a first support leg portion 34 hingedly mounted to the pedestal ]4 about the first hinge 16. A guide tube 39 receives a second support leg 35 in adjacency and parallel the first support leg 34, such as a gear rack 36 mounted to the second support leg 35 and cooperative with a rotary gear 37 rotatably mounted to a free distal end of the first support leg 34, as the rotary gear 37 includes a rotary gear handle 38 permitting ease of rotation of the rotary gear 37 to permit vertical adjustment of the first support plate 34 relative to the second support leg 35 to provide for spaced adjustment of the further support leg 21 relative to the base plate 11.

The FIGS. 7 and 8 indicate the use of the support leg structure 33, wherein the guide tube 39 secures the first support leg 34 with the second support leg 35 spaced to the rear surface of the first support leg 34 to permit interfolding and reception of the first support leg along the pedestal As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A feeding tube support apparatus, comprising,
   - a base plate, the base plate having a base plate first end spaced from a base plate second end, and
   - a pedestal fixedly mounted to the base plate in adjacency to the base plate second end, and
   - a support legs having a support leg first end and a support second end with a first hinge mounted to the support leg first end and to the pedestal, and
   - first latch means secured to the support leg adjacent the support leg first end for securement of the support leg first end relative to the base plate second end, and
   - a further support leg hingedly mounted to the support leg second end about a second hinge, and second latch means mounted to the further support leg for securement to the further support leg in a latch arrangement relative to the support leg, and the further support leg having a support leg opening directed through the further support leg adjacent a further support leg free distal end spaced from the further support leg latch means for receiving a feed tube through the further support leg opening, and the first latch means includes a latch bolt slidably mounted relative to the support leg first end, and a latch bolt tube mounted to the base plate second end for receiving the latch bolt therewithin, and the second latch means includes a securement strap mounted to the support leg, the securement strap having a securement strap opening, and a lug mounted to the support leg, adjacent the support leg second end, with the lug arranged for reception through the securement strap opening.

2. An apparatus as set forth in claim 1including at least one T-shaped groove mounted into the base plate spaced from the first hinge extending from the pedestal to the base plate first end, with at least one T-shaped lug slidably mounted within the at least one T-shaped groove, and the T-shaped lug including a split cylindrical spring clamp integrally mounted to the T-shaped lug, with the split cylindrical spring clamp arranged for receiving a further spring tube therewithin.

3. An apparatus as set forth in claim 2 wherein the support leg includes a first leg portion and a second leg portion, with the first leg portion including the first hinge, and the first leg portion including a rotary gear, the second leg portion extending from the first leg portion, and the second leg portion including a gear rack cooperative with the rotary gear, and a guide tube mounted to the first leg portion for receiving slidably the second leg portion therethrough to maintain engagement of the rotary gear with the gear rack.

* * * * *